United States Patent [19]

Tsuyuguchi

[11] 4,058,216

[45] Nov. 15, 1977

[54] DEVICE FOR PACKING ROLL-LIKE ARTICLES

[75] Inventor: Tadao Tsuyuguchi, Gifu, Japan

[73] Assignee: Teijin Limited, Osaka, Japan

[21] Appl. No.: 568,098

[22] Filed: Apr. 14, 1975

[30] Foreign Application Priority Data

Apr. 16, 1974 Japan ..... 49-41704

[51] Int. Cl.[2] ..... B65D 85/66; B65D 19/00; B65D 71/02

[52] U.S. Cl. ..... 206/597; 206/416; 206/585; 206/391

[58] Field of Search ..... 206/416, 415, 414, 391, 206/413, 389, 386, 408, 597, 585

[56] References Cited

U.S. PATENT DOCUMENTS

| | | | |
|---|---|---|---|
| 6,533 | 7/1875 | Firm | 206/416 |
| 1,342,909 | 6/1920 | Hope | 206/408 |
| 1,954,848 | 4/1934 | Scott | 206/414 |
| 3,193,179 | 7/1965 | Bogren | 206/391 |
| 3,489,274 | 1/1970 | Hughes et al. | 206/391 |
| 3,700,099 | 10/1972 | Heroux | 206/415 |
| 3,737,028 | 6/1973 | Carlson | 206/416 |

FOREIGN PATENT DOCUMENTS

| | | | |
|---|---|---|---|
| 1,486,562 | 3/1969 | Germany | 206/415 |

*Primary Examiner*—William T. Dixson, Jr.
*Attorney, Agent, or Firm*—Wenderoth, Lind & Ponack

[57] ABSTRACT

A capping device for use in packing roll-like articles wound up on a core comprising a polygonal face wall for protecting the end surface of a roll-like article, a side wall provided around said face wall for protecting the edge of the roll-like article, and a protrusion to be connected to the core of the roll-like article projecting from the center of said face wall into a space surrounded by said side wall.

2 Claims, 8 Drawing Figures

DEVICE FOR PACKING ROLL-LIKE ARTICLES

This invention relates to a device used for packing roll-like articles wound up on a core.

Sheet-like materials such as plastic films, paper, metal foils or woven fabrics are generally cut to a predetermined width, wound up on a core to a predetermined length, and made into a roll-like article. In order to prevent the damage to such a roll-like article during transportation or storage, a case-packing method using cases such as paper or wooden boxes has been employed most widely. Such a packing method could successfully prevent the contamination and damage of roll-like articles which is the basic purpose of packing, but it still poses a number of problems among which are:

1. Very high packing costs are required.
2. Such cases as paper or wooden boxes have poor durability, and are difficult to reuse.
3. The packing operation is complicated, and requires a great deal of labor.
4. Many kinds of cases are required for different widths of roll-like materials.
5. The cases occupy a large volume at the time of transportation or storage, and require a wide storage place.
6. Empty cases have a very high percentage of voids, and a large, otherwise unnecessary space is required for storage.
7. Complicated works are required for opening the packages or disposing of the used cases.

Accordingly, it is an object of this invention to solve the above problems by discovering a novel device for use in packing roll-like articles wound on a core.

Other objects of this invention will become apparent from the following description.

According to this invention, there is provided a capping device which meets the above object, and comprises a polygonal face wall for protecting the end surface of a roll-like article, a side wall provided around said face wall for protecting the end edge of the roll-like article, and a protrusion to be connected to the core of the roll-like article projecting from the center of said face wall into a space surrounded by said side wall.

The capping device of this invention will be described specifically by reference to the accompanying drawings in which.

Figure 1:
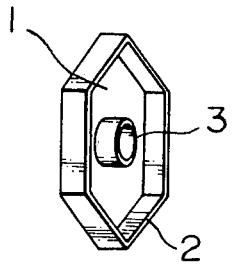
FIG. 1 is a perspective view showing one example of the capping device of this invention.
Figure 2:
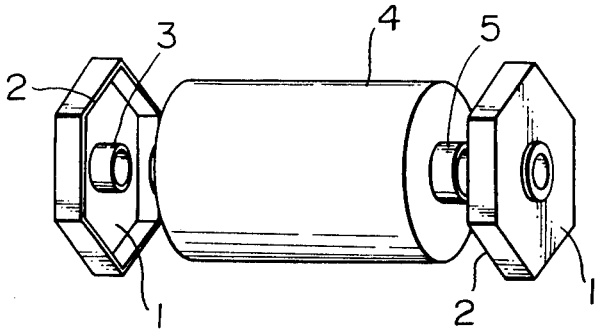
FIG. 2 is a perspective view showing the state wherein the capping device of this invention is being secured to both end portions of a roll-like article wound up on a core.
Figure 3:
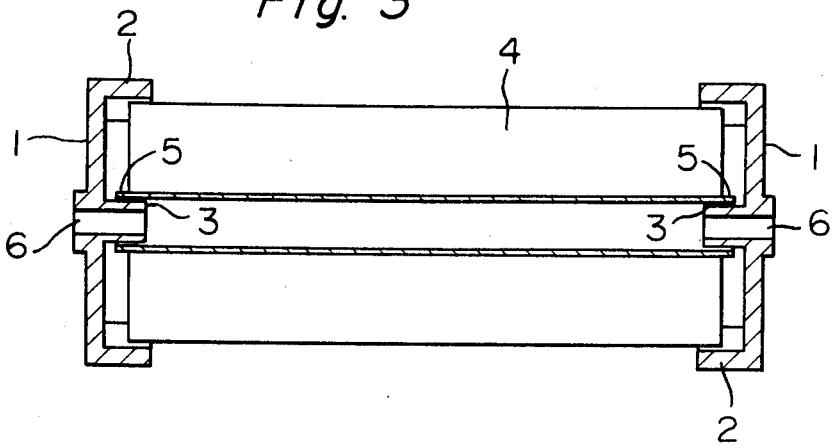
FIG. 3 is a sectional view showing the state wherein the capping device of this invention have been secured to both end portions of a roll-like article wound up on a core.

In FIG. 1, the reference numeral 1 represents a regular hexagonal face wall; 2, a side wall having a regular hexagonal contour provided around the face wall; and 3, a cylindrical projection. In this embodiment, the regular hexagonal contour surrounded by the side wall 2 has a size that can include the circular contour of a roll-like article to which the device of this invention is to be secured, and the protrusion 3 has an outside diameter conformable to the inside diameter of the cylindrical winding core of the roll-like article. Thus, as shown in FIGS. 2 and 3, when the protrusion 3 of the capping device of this invention is inserted in the hollow portions at both ends of a cylindrical core 5 of a roll-like article 4, the roll-like article presents a view as if a cap were put on its both end portions. Thus, the end surfaces of the roll-like article 4 are protected by the face wall 1, and its end edges, by the side wall 2. In the following description, roll-like article 4, to both ends of which are secured the capping device in the above state, will be referred to as "packaged roll-like articles."

In the embodiment shown in FIGS. 1 to 3, a hole 6 is perforated through the face wall 1 and the protrusion 3, as shown in FIG. 3. This hole 6 communicates with the inner cavity of the core 5, as shown in FIG. 3, to form a tunnel leading from one capping device to another when the capping devices of this invention are secured to both end portions of the roll-like article 4. As will be described hereinbelow, this tunnel can be advantageously utilized when packing an assembly of packaged roll-like articles.

The roll-like article can be wrapped with a cover such as a plastic film in order to prevent contamination when the capping device of this invention is secured to both end portions of the roll-like article. Furthermore, in order to protect the end faces and edges of the roll-like article 4, a cushioning material such as polyurethane foam can be interposed between the end face of the packaged roll-like article and the inner face of the capping device.

Figure 4:
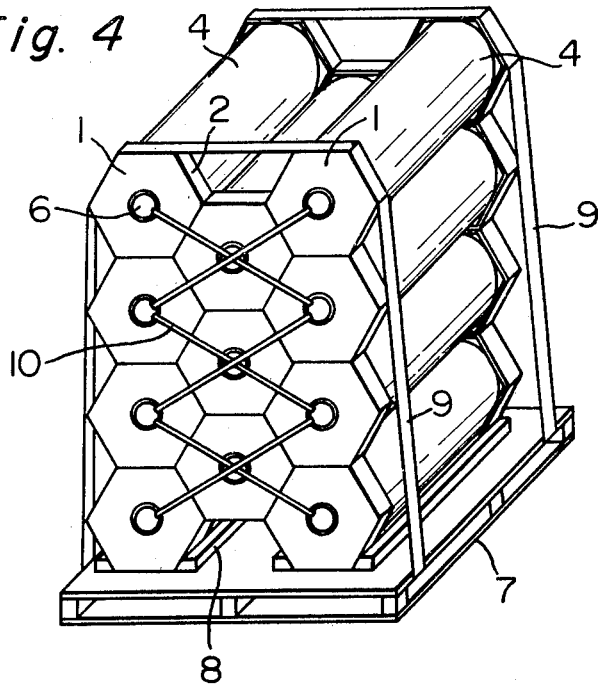
FIG. 4 is a perspective view showing the state wherein a number of roll-like articles, to both ends of which are secured the capping device of this invention, are stacked and tied by a band for packing.

A number of packaged roll-like articles each formed by securing the capping device to both end portions of the roll-like article 4 need to be packed together for transportation or storage. One example of the method for such packing is shown in FIG. 4 which indicate that eleven packaged roll-like articles are stacked in four rows and three vertical arrangements (four rows in the first vertical arrangement, three rows in the second vertical arrangement, and four rows in the third vertical arrangement) on a pallet 7 equipped with a guide 8 utilizing the side wall having a regular hexagonal contour. The side walls of the capping devices at the topmost row are tied to the pallet by means of a band 9. A band 10 is passed through the tunnels leading to the holes 6 to tie the packaged roll-like articles to each other.

Figure 5:
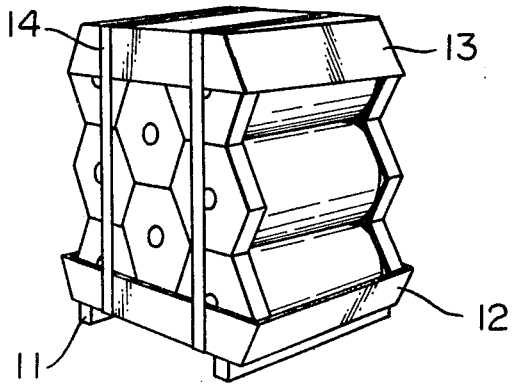
FIG. 5 is a perspective view showing another embodiment of packing method different from that shown in FIG. 4.

FIG. 5 illustrates another method for packing a number of packaged roll-like articles in a unitary structure. In the embodiment shown in FIG. 5, eight packaged roll-like articles are stacked in three rows and three vertical arrangements with the individual side walls of a regular hexagonal contour contacting each other intimately in a tray 12 equipped with legs 11 at its undersurface, and a tray 13 is placed upside down on the topmost article. The tray 12 is tied with the tray 13 by means of a band 14.

Figure 6:
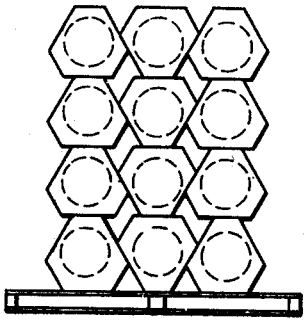
FIGS. 6 to 8 are schematic front views showing methods of stacking for packing purposes which are used when other embodiments of the capping device of this invention are used.
Figure 7:
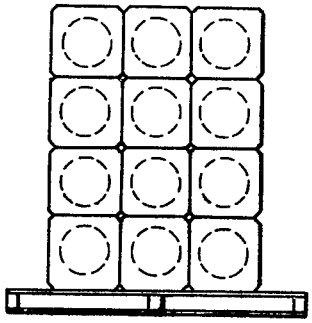
Figure 8:
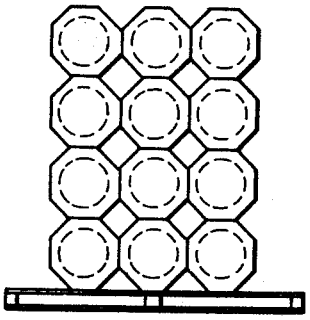

The capping device of this invention is not limited to those in which face walls and side walls have a regular hexagonal contour, but may include other devices in which the face walls and side walls have a contour of other polygons such as a triangle, tetragon, hexagon, or octagon. FIGS. 6 to 8 show the states in which a number of packaged roll-like articles formed by using such capping devices are stacked in a regular order on a pallet with the individual side walls connecting each other. In the same way as in FIGS. 4 and 5, when the side wall of the topmost article is tied with the pallet, a pack of firmly bundled roll-like articles is formed.

The following Examples demonstrate the merits of this invention.

EXAMPLE 1

Packaged roll-like articles each formed by securing a capping device having a regular hexagonal contour at both ends of a plastic film roll having a weight of 85 Kg, a woundup diameter of 300 mm and a width of 1000 mm were stacked on a pallet in four rows and three vertical arrangements (four rows in the first vertical arrangement, three rows in the second vertical arrangement, and four rows in the third vertical arrangement; the total number of the roll-like articles is 11), and tied by means of a band. The pack so prepared was transported on a lorry over a distance of 800 Km. There was no movement nor collapsing of the load.

When the same test as above was conducted except that using capping devices having a square contour and capping devices having a regular octagonal contour, twelve packaged roll-like articles were stacked in four rows and three vertical arrangements (four rows in each vertical arrangement) as shown in FIGS. 7 and 8. Much the same results as above were obtained.

EXAMPLE 2

Packaged roll-like articles each formed by securing a capping device having a regular hexagonal contour to both end portions of a plastic film roll having a weight of 75 Kg and a width of 2800 mm were stacked in three rows and nine vertical arrangements (three rows in the first, third, fifth, seventh and ninth vertical arrangements, and two rows in the second, fourth, sixth and eighth vertical arrangements) on a tray in accordance with the stacking method illustrated in FIG. 5, and a tray was placed on the stacked assembly, and the assembly was tied by means of a band. The resulting pack was tested in the same way as in Example 1, and the same results as in Example 1 were obtained.

The capping device of this invention may be made by any material so long as it breaks by its weight when it is secured to both ends of a roll-like article or by the tying force of a band which ties the stacked roll-like articles. For example, it is made of plastics, wood, and metals. Plastics are most suitable because they can be fabricated simply into a unitary structure.

Since the capping device of this invention has a contour having a size sufficient for including the circular contour of a roll-like article, the end surfaces and edges of the roll-like article can be protected. In addition, when a number of packaged roll-like articles are tied by a band after stacking them with their side walls contacting each other so as to pack them into a single pack, the individual roll-like articles do not contact each other, but are maintained in the separated state. Thus, according to this invention, roll-like articles can be prevented from being damaged by mutual contact during transportation as is the case with the conventional packing methods.

Other advantages of this invention are as follows:

1. The capping device of this invention has a simple structure and is low cost.
2. Since the capping device is tough and resistant to breakage, it can be used repeatedly.
3. Since the capping device is not bulky, it does not occupy a large space for storage when it is not in use.
4. Since the capping device has nothing to do with the width of a roll-like article, it is not necessary to prepare various capping devices for different widths of roll-like articles.
5. The packaged roll-like article can be formed by a simple work, and a number of such packaged roll-like articles can be simply stacked and tied together by utilizing polygonal side walls. Accordingly, the use of the capping device of this invention reduces the cost of packing.

What we claim is:

1. A capping device for use in packaging roll-like articles wound onto a hollow core, said device comprising:

a hexagonal face wall adjacent the end surface of said article for protecting said end surface, said face wall having a hole therethrough corresponding to the hollow core of said article;

cushioning material between said face wall and the end surface of said article;

a hollow protrustion surrounding said hole in said face wall extending therefrom into said hollow core; and a side wall surrounding said face wall and extending therefrom towards said article for protecting the edges of the end of said article.

2. Means for stacking and securing together roll-like articles wound onto a hollow core comprising:

a plurality of said roll-like articles having first and second ends;

a plurality of capping and stacking means on both ends of said roll-like articles for forming flat stacking surfaces on said roll-like articles and for protecting the ends of said articles, said capping means on said first ends contacting each other and said capping means on said second ends also contacting each other, each capping and stacking means comprised of:

a hexagonal face wall adjacent the end surface of said article for protecting said end surface, said face wall having a hole therethrough corresponding to the hollow core of said article, cushioning material between said face wall and the end surface of said article, a hollow protrustion surrounding said hole in said face wall extending therefrom into said hollow core, and a side wall surrounding said face wall and extending therefrom towards said article for protecting the edges of the end of said article;

a support beneath said plurality of roll-like articles;

first band means passing through said hollow protrusions in said capping means and said hollow cores of said roll-like articles for holding said capped roll-like articles together; and second band means attached to said base and surrounding said roll-like articles for securing said articles to said base.

* * * * *